US012214930B2

(12) United States Patent
Parker et al.

(10) Patent No.: US 12,214,930 B2
(45) Date of Patent: Feb. 4, 2025

(54) STACKABLE LIQUID VESSEL AND MULTI-VESSEL ARRANGEMENT

(71) Applicants: Jeffrey A. Parker, Weatherford, TX (US); Blair Bentham, Surrey (CA)

(72) Inventors: Jeffrey A. Parker, Weatherford, TX (US); Blair Bentham, Surrey (CA)

( * ) Notice: Subject to any disclaimer, the term of this patent is extended or adjusted under 35 U.S.C. 154(b) by 0 days.

(21) Appl. No.: 17/992,910

(22) Filed: Nov. 22, 2022

(65) Prior Publication Data

US 2023/0159221 A1 May 25, 2023

Related U.S. Application Data

(60) Provisional application No. 63/282,376, filed on Nov. 23, 2021.

(51) Int. Cl.

| | |
|---|---|
| ***B65D 21/02*** | (2006.01) |
| ***B65D 1/02*** | (2006.01) |
| ***B65D 1/44*** | (2006.01) |
| ***B65D 23/10*** | (2006.01) |
| ***B65D 71/00*** | (2006.01) |

(52) U.S. Cl.

CPC ..... *B65D 21/0231* (2013.01); *B65D 1/023* (2013.01); *B65D 1/0276* (2013.01); *B65D 1/44* (2013.01); *B65D 23/102* (2013.01); *B65D 71/0096* (2013.01); *B65D 2501/0036* (2013.01); *B65D 2501/0081* (2013.01); *B65D 2571/00012* (2013.01); *B65D 2571/00043* (2013.01)

(58) Field of Classification Search

CPC .. B65D 21/0231; B65D 1/023; B65D 1/0276; B65D 1/44; B65D 23/102; B65D 2501/0036; B65D 2501/0081; B65D 71/0096; B65D 2571/00012; B65D 2571/00043

See application file for complete search history.

(56) References Cited

U.S. PATENT DOCUMENTS

| | | | | |
|---|---|---|---|---|
| D581,271 | S | 11/2008 | Laupie | |
| 7,699,171 | B2 * | 4/2010 | Rivera | B65D 21/0231 206/508 |
| 8,235,214 | B2 * | 8/2012 | Eiten | B65D 71/0096 206/499 |
| 9,561,879 | B2 * | 2/2017 | Touchet | B65D 71/08 |
| 9,701,433 | B2 * | 7/2017 | Boukobza | B65D 21/0231 |
| 9,725,201 | B2 * | 8/2017 | Derrien | B65D 1/0207 |
| 10,518,933 | B2 * | 12/2019 | Dorn | B65D 21/0231 |
| 11,286,104 | B2 * | 3/2022 | Corbett | B65D 25/32 |
| 2007/0114200 | A1 * | 5/2007 | Lane | B65D 23/102 206/508 |

(Continued)

*Primary Examiner* — Nathan J Jenness
*Assistant Examiner* — Jennifer Castriotta
(74) *Attorney, Agent, or Firm* — Genius Patent APC; Bruce Angus Hare

(57) ABSTRACT

A stackable liquid vessel may be able to receive, store, and dispense various liquids or fluids, such as beverages, cooking oil or vinegar, motor oil, and/or other appropriate materials or substances. Each stackable liquid vessel may be able to at least partially couple to at least one other stackable liquid vessel. An arrangement of stackable liquid vessels may utilize perforated slipsheets to reduce material usage when packing, shipping, storing, and/or displaying multiple stackable liquid vessels (e.g., a pallet of stackable vessels).

16 Claims, 14 Drawing Sheets

(56) References Cited

U.S. PATENT DOCUMENTS

| | | | | |
|---|---|---|---|---|
| 2013/0240401 | A1* | 9/2013 | Hall | B65D 23/102<br>220/601 |
| 2014/0319010 | A1* | 10/2014 | Derrien | B65D 1/0276<br>206/509 |

* cited by examiner

STACKABLE LIQUID VESSEL AND MULTI-VESSEL ARRANGEMENT

CROSS-REFERENCE TO RELATED APPLICATIONS

This application claims priority to U.S. Provisional Patent Application Ser. No. 63/282,376, filed on Nov. 23, 2021.

BACKGROUND

Existing liquid containers utilize excessive amounts of packaging, such as corrugated cardboard. Further, existing containers may be damaged or compromised during shipping, handling, and/or storage. Finally, consumers may not be able to easily access the containers from a multi-unit arrangement.

Therefore, there exists a need for a liquid vessel that reduces use of packaging or other materials, is structurally sound during shipping and handling, and provides access for consumers.

BRIEF DESCRIPTION OF THE SEVERAL VIEWS OF THE DRAWING

The novel features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide a stackable liquid vessel. The stackable liquid vessel may be able to receive, store, and dispense various liquids or fluids, such as beverages, cooking oil or vinegar, motor oil, and/or other appropriate materials or substances. Each stackable liquid vessel may be able to at least partially couple to at least one other stackable liquid vessel. An arrangement of stackable liquid vessels may utilize perforated slipsheets to reduce material usage when packing, shipping, storing, and/or displaying multiple stackable liquid vessels (e.g., a pallet of stackable vessels). The stackable liquid vessel may alternatively be referred to as a "container", "bottle", "package", and/or other similar terms with or without various adjectives (e.g., "vessel", "stackable vessel", "nested bottle", "nested beverage container", etc.) throughout this disclosure.

Figure 1:
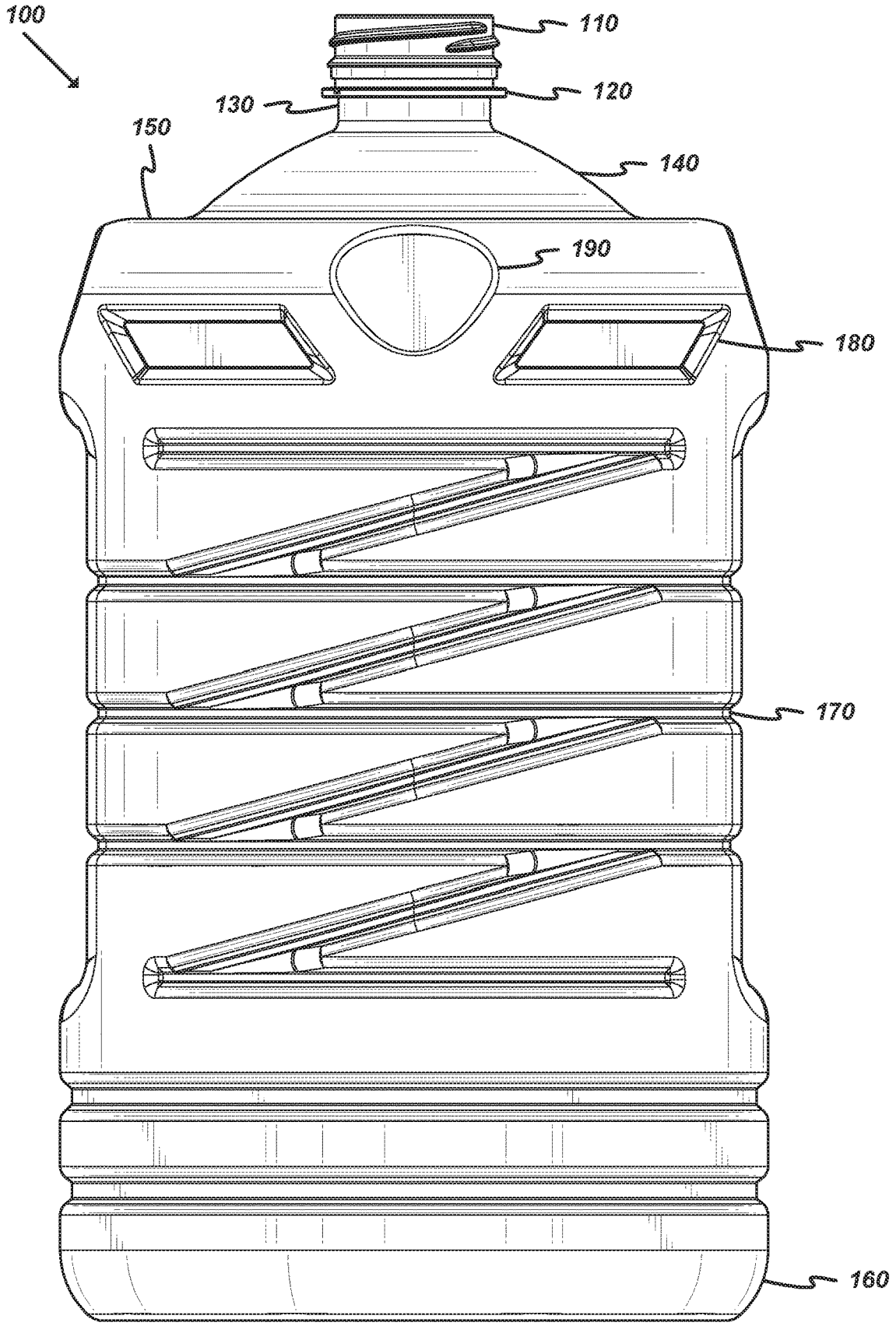
FIG. 1 illustrates a front elevation view of a stackable liquid vessel of one or more embodiments described herein.

FIG. 1 illustrates a front elevation view of a stackable liquid vessel 100 of one or more embodiments described herein. As shown, the stackable liquid vessel 100 may include a neck finish and mouth 110, a transfer bead 120, a neck 130, a shoulder extension 140, a shoulder support 150, a heel 160, and various structural support elements 170-190.

Figure 2:
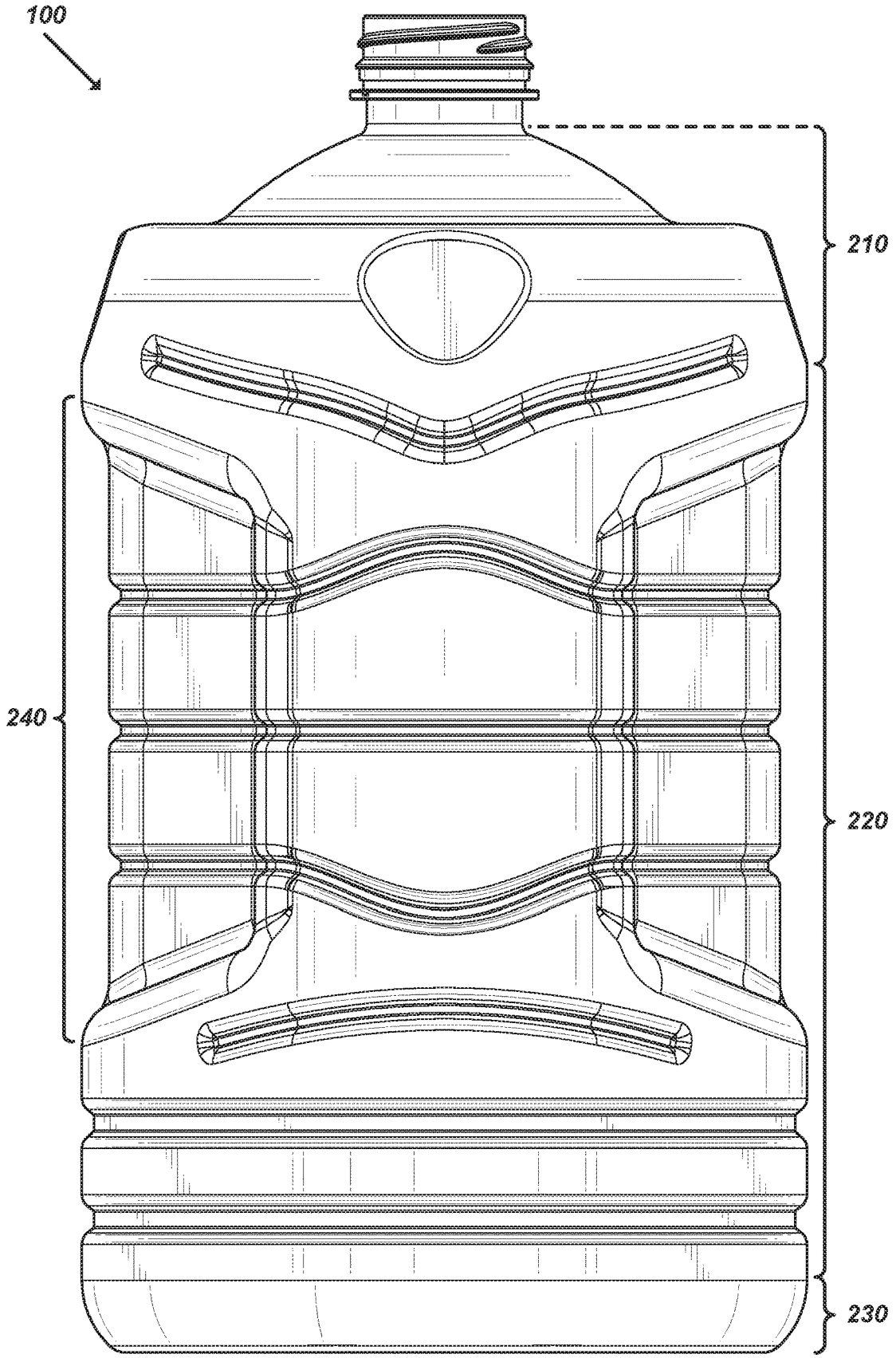
FIG. 2 illustrates a rear elevation view of the stackable liquid vessel of FIG. 1.

FIG. 2 illustrates a rear elevation view of the stackable liquid vessel 100. As shown, stackable liquid vessel 100 may include a shoulder portion 210, a sidewall or body portion 220, a base portion 230, and a handle portion 240.

Figure 3:
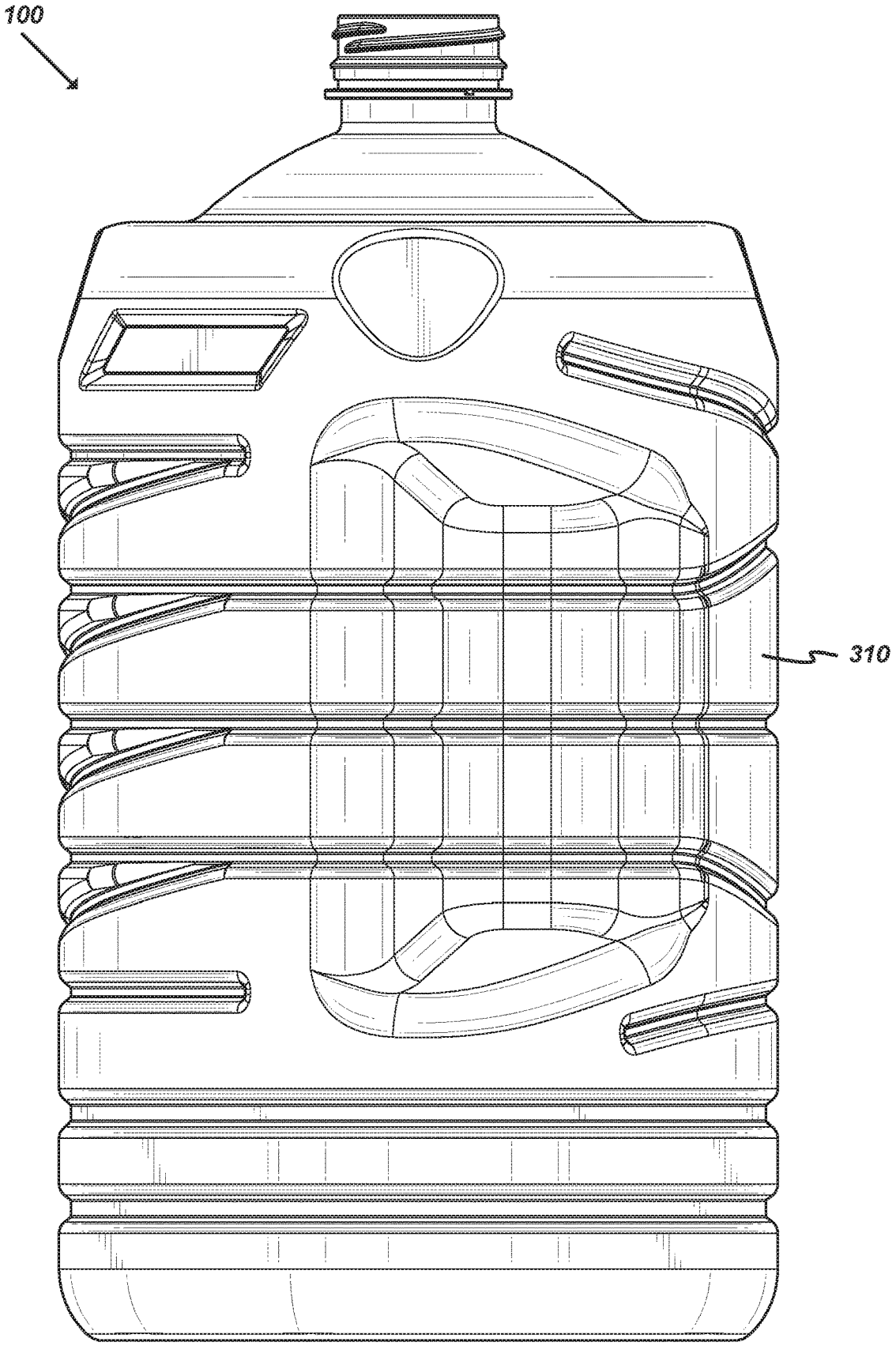
FIG. 3 illustrates a left elevation view of the stackable liquid vessel of FIG. 1.

FIG. 3 illustrates a left elevation view of the stackable liquid vessel 100. As shown, stackable liquid vessel 100 may include an integrated handle 310.

Figure 4:
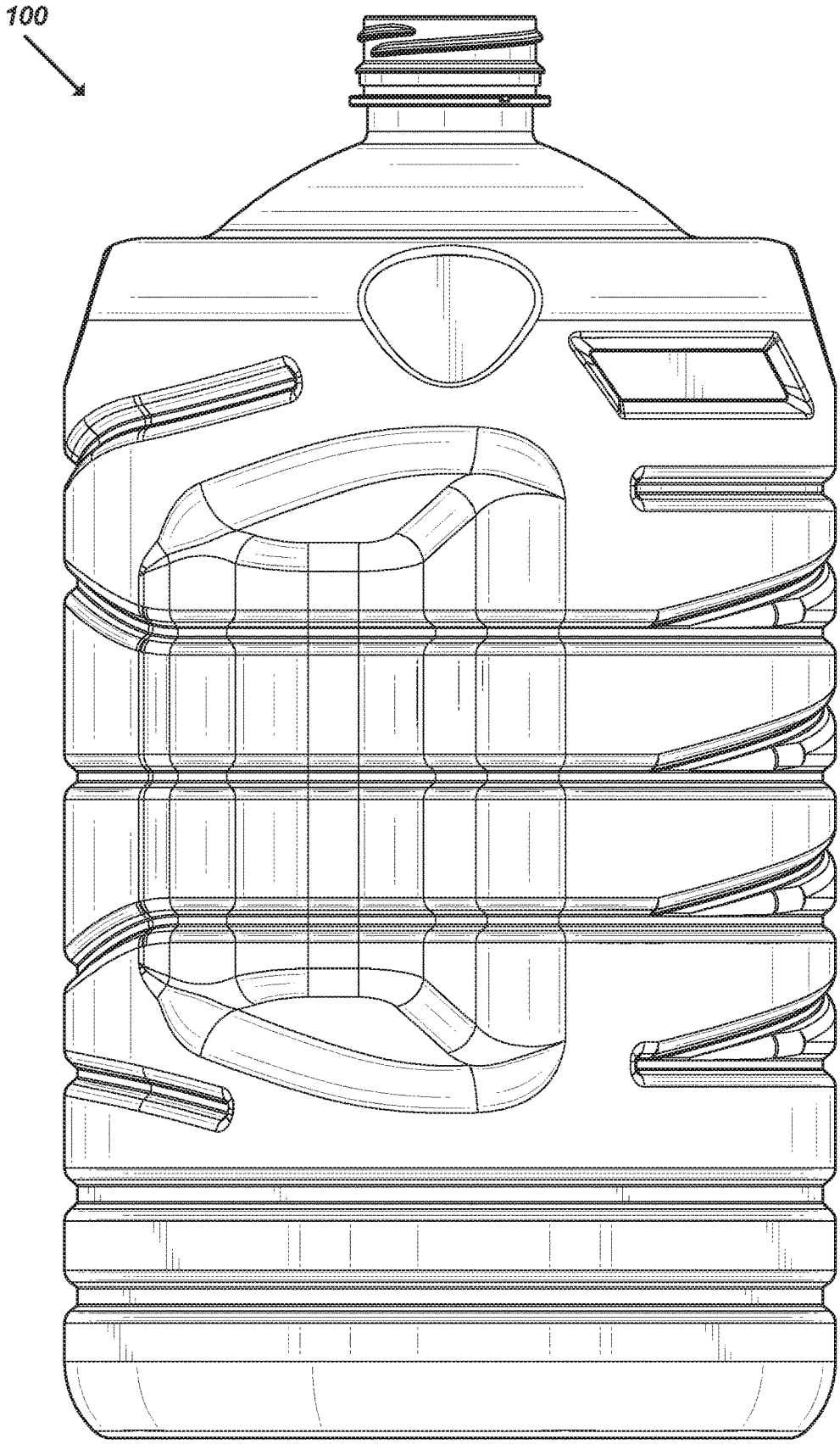
FIG. 4 illustrates a right elevation view of the stackable liquid vessel of FIG. 1.

FIG. 4 illustrates a right elevation view of the stackable liquid vessel 100.

Figure 5:
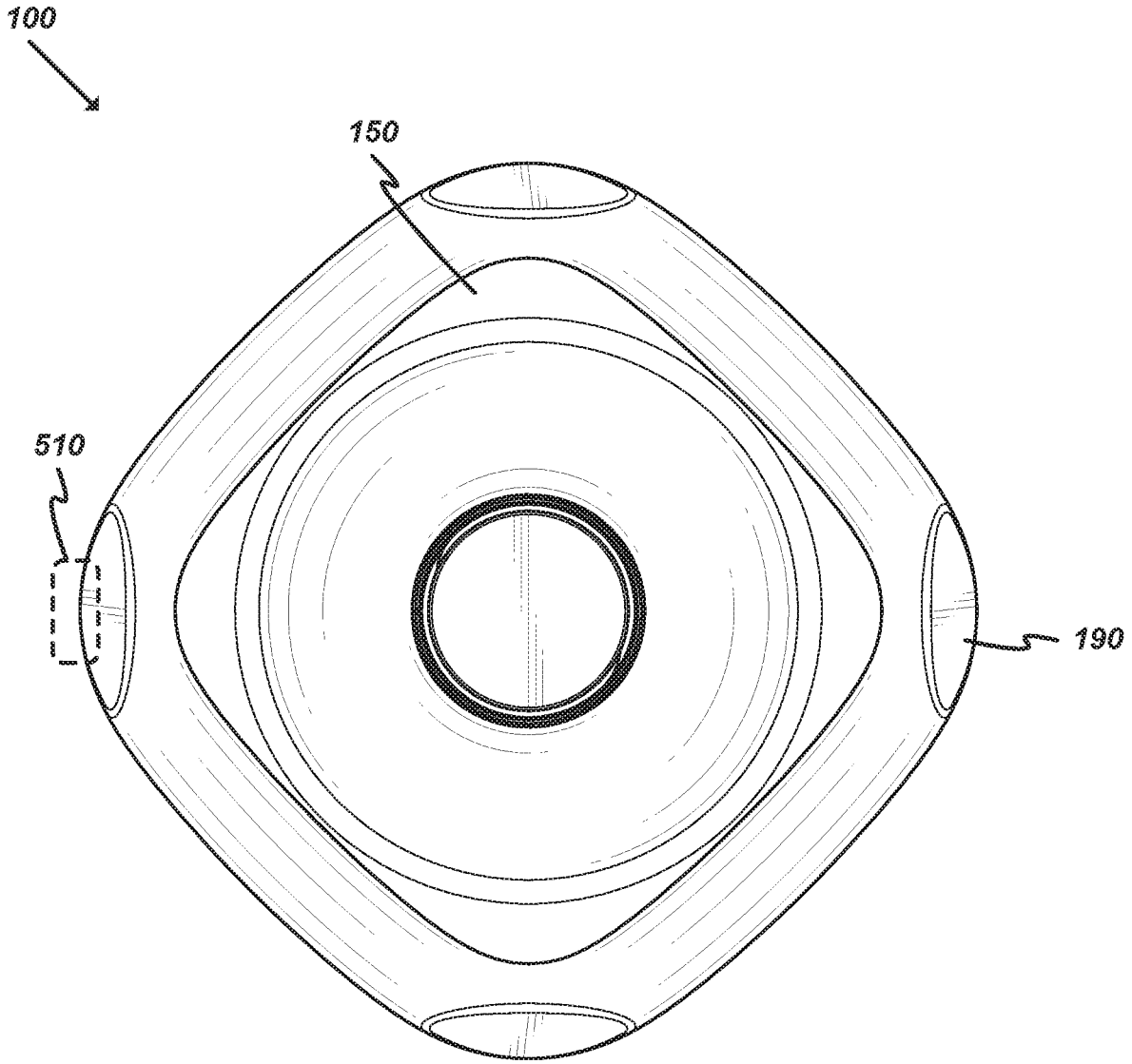
FIG. 5 illustrates a top plan view of the stackable liquid vessel of FIG. 1.

FIG. 5 illustrates a top plan view of the stackable liquid vessel 100. As shown, stackable liquid vessel may have a rounded square shape relative to vertical axis 710 and may include four vertical "corners" 510 or inflection points that may run parallel to the vertical axis 130 along at least portions of sidewalls 220, base 230, handle portion 240, and/or shoulder 210. The areas between vertical corners 510 may be referred to as the "sides" or "vertical sides" of vessel 100.

Figure 6:
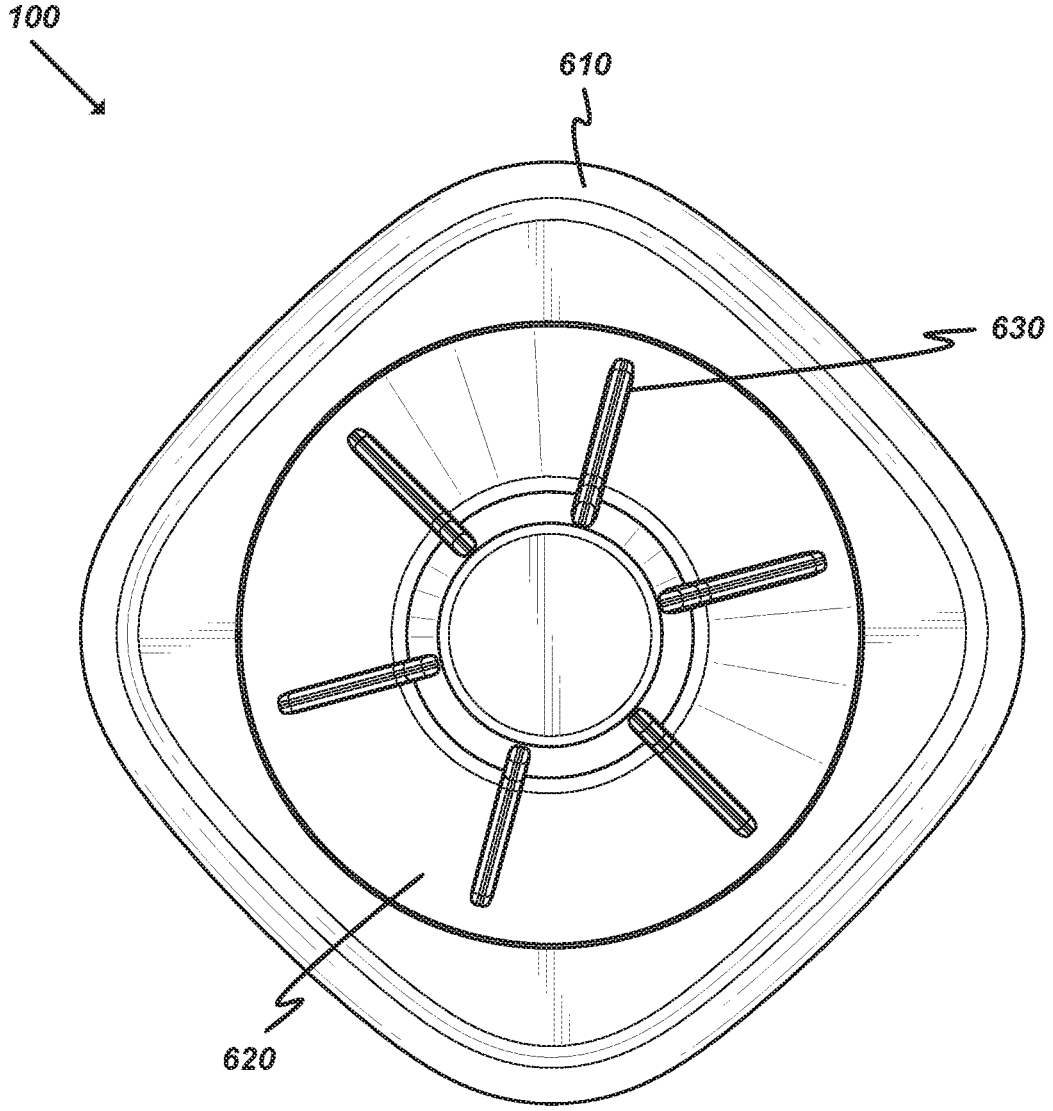
FIG. 6 illustrates a bottom plan view of the stackable liquid vessel of FIG. 1.

FIG. 6 illustrates a bottom plan view of the stackable liquid vessel 100. As shown, stackable liquid vessel 100 may include a base 610, a stacking receptacle 620, and various receptacle supports 630.

Figure 7:
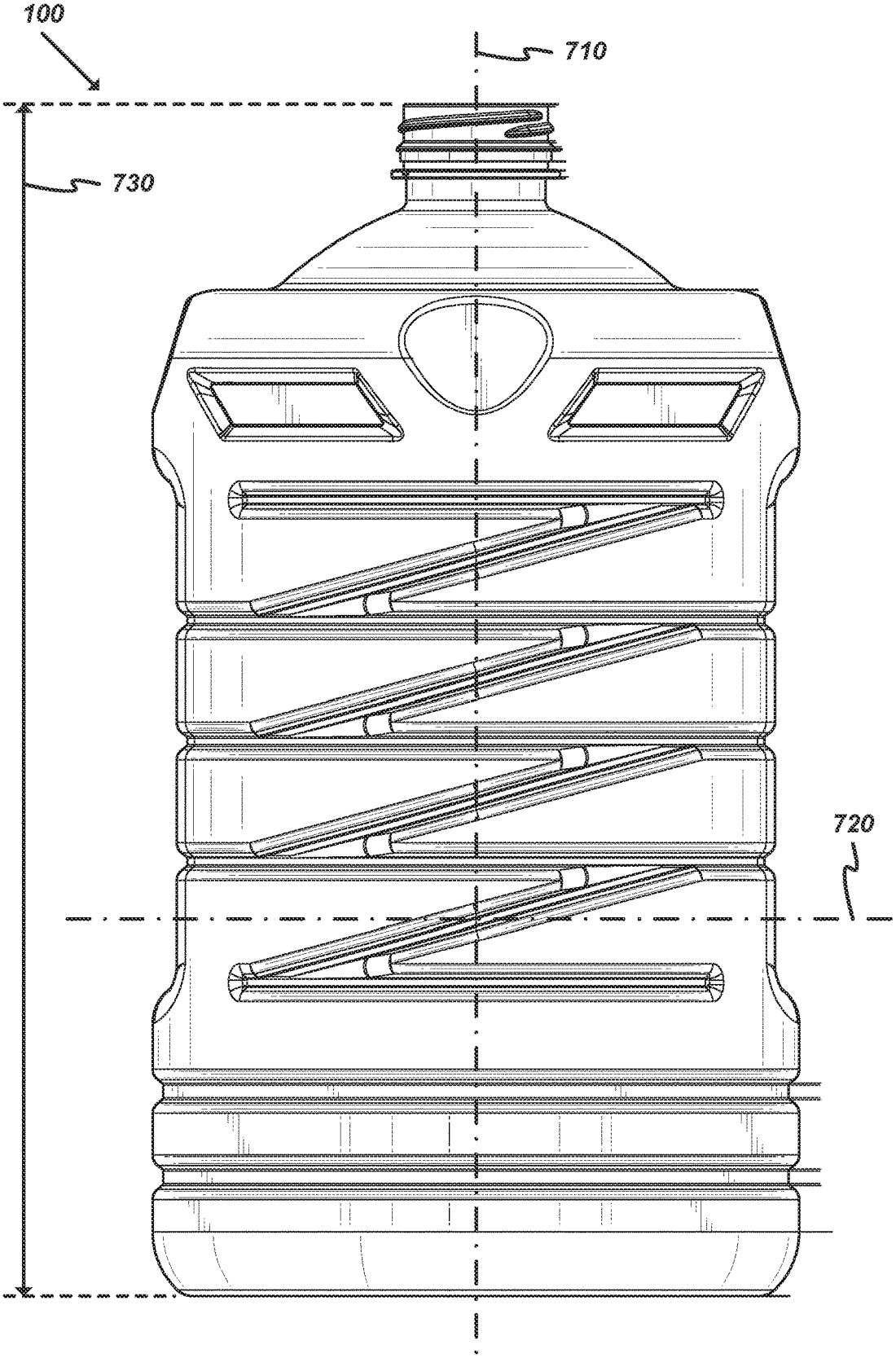
FIG. 7 illustrates a front elevation view of a stackable liquid vessel of FIG. 1.

FIG. 7 illustrates a front elevation view of a stackable liquid vessel 100. This example includes a vertical axis or reference line 710 and a horizontal axis or reference line 720.

Figure 8:
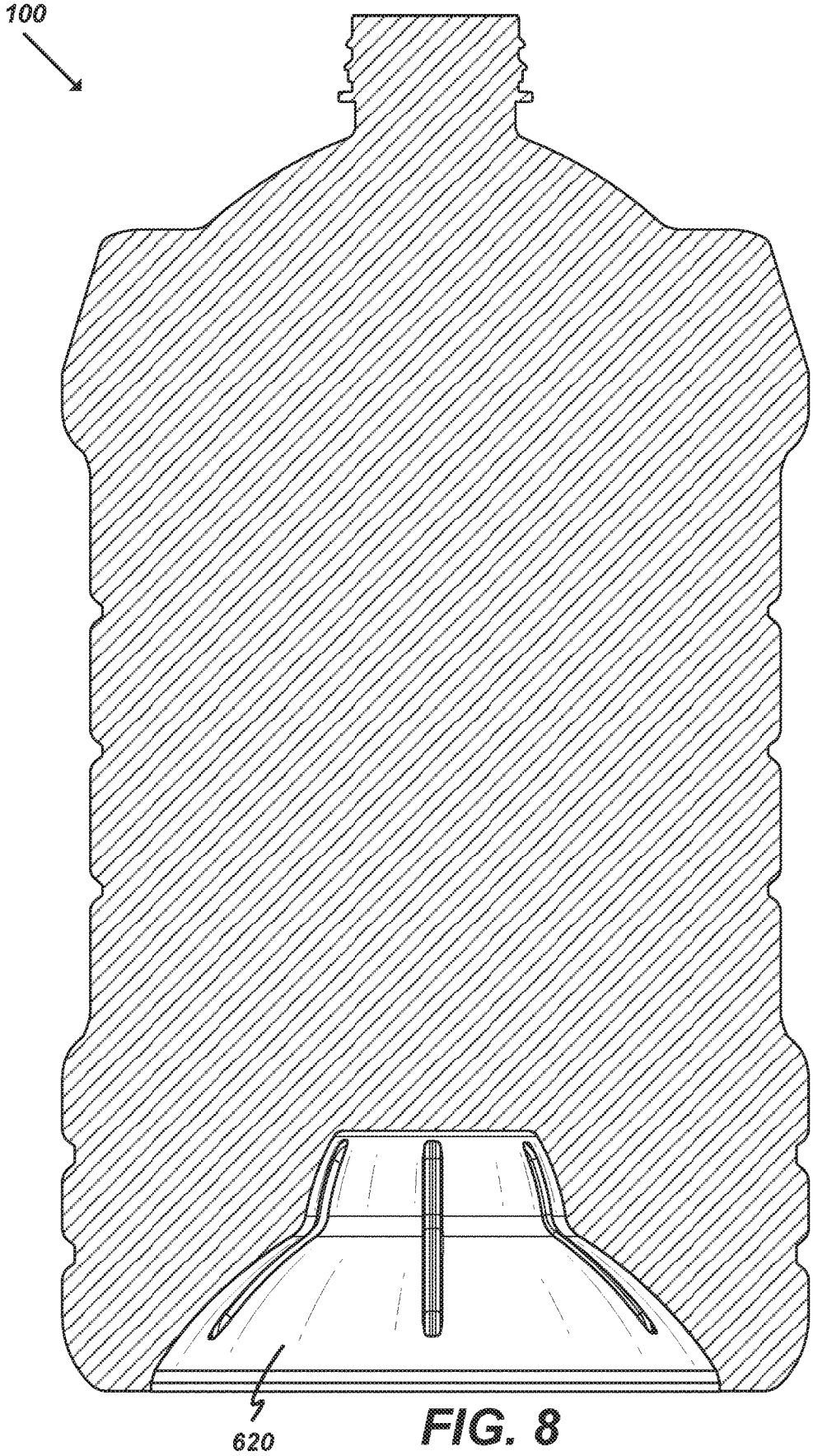
FIG. 8 illustrates a front section view of the stackable liquid vessel of FIG. 1.

FIG. 8 illustrates a front section view of the stackable liquid vessel 100.

Figure 9:
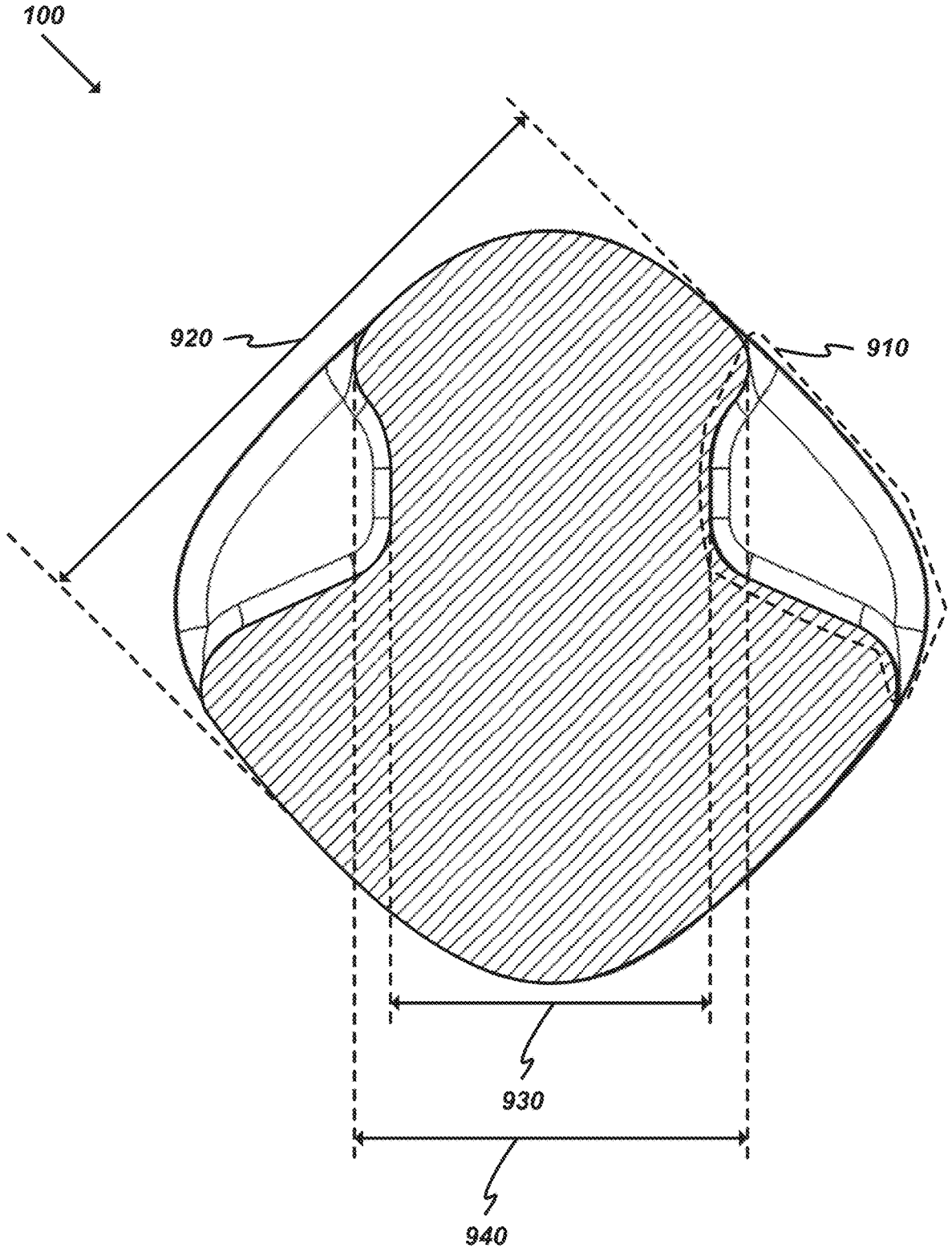
FIG. 9 illustrates a top section view of a stackable liquid vessel of FIG. 1.

FIG. 9 illustrates a top section view of the stackable liquid vessel 100. As shown, the stackable liquid vessel 100 may include grip regions 1410 disposed about handle 310.

Figure 10:
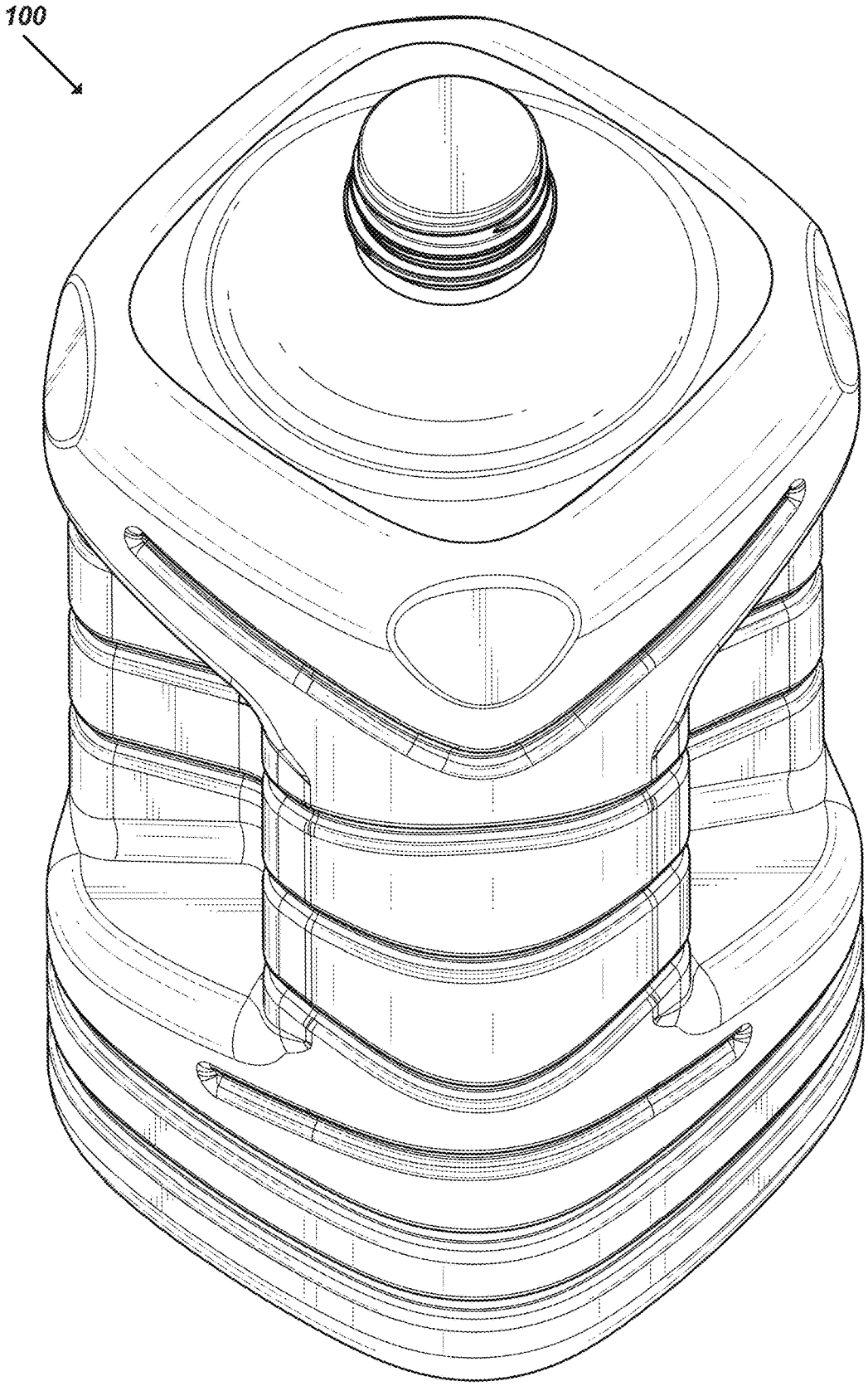
FIG. 10 illustrates a top, rear perspective view of the stackable liquid vessel of FIG. 1.

FIG. 10 illustrates a top, rear perspective view of the stackable liquid vessel 100.

Figure 11:
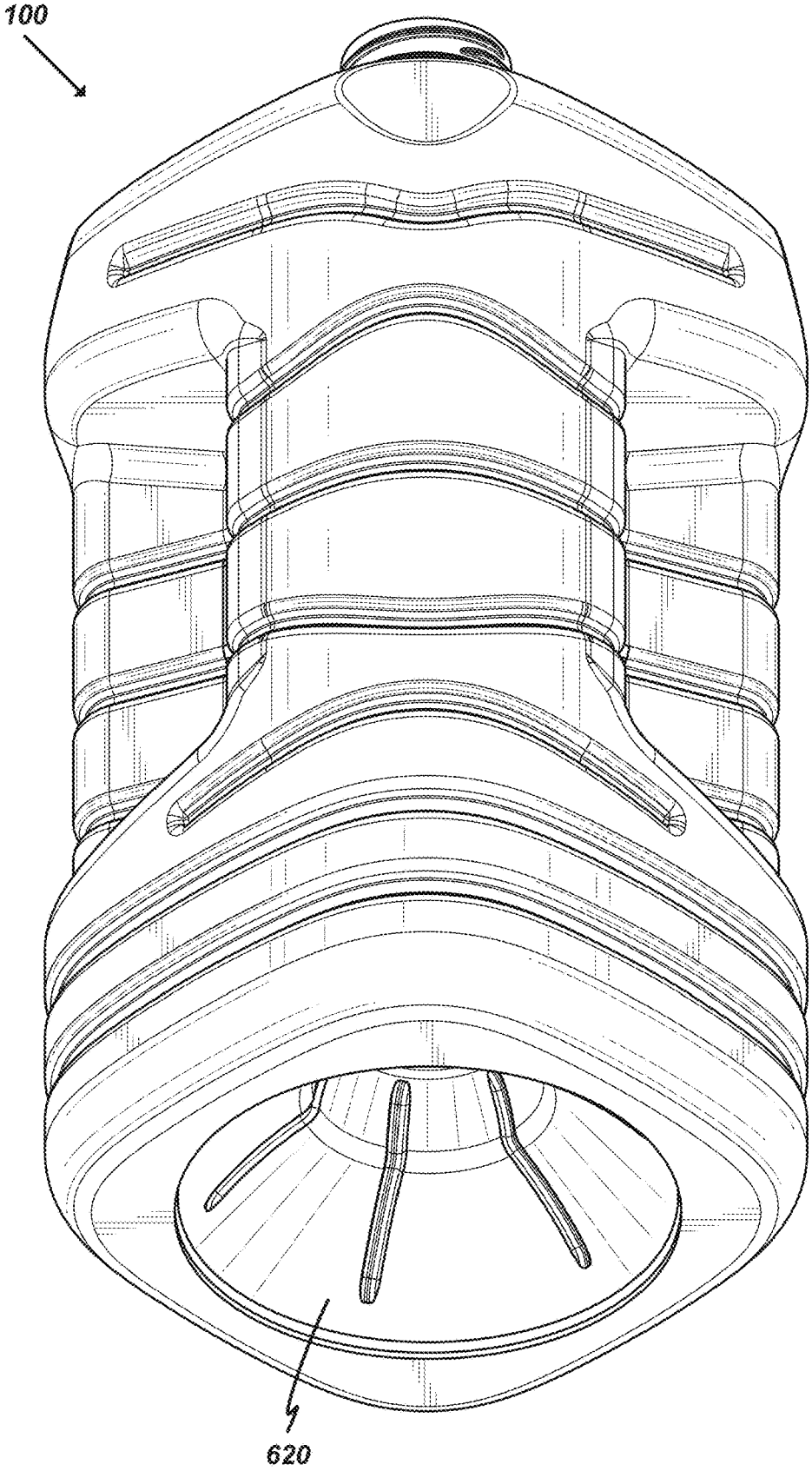
FIG. 11 illustrates a bottom, rear perspective view of the stackable liquid vessel of FIG. 1.

FIG. 11 illustrates a bottom, rear perspective view of the stackable liquid vessel 100.

The stackable liquid vessel 100 may be formed of rigid or semi-rigid materials such as plastic (e.g., polyethylene terephthalate (PET)) using molding processes such as injection molding or blow molding. The materials may be suitable for the transportation and human consumption of beverages such as drinking water.

Neck finish and mouth 110 may have a cylindrical or annular shape and may be symmetrical about vertical axis 710. Neck finish and mouth 110 may include a threaded exterior, as shown and may be associated with elements such as a top seal, cap, etc.

Transfer bead 120 may be utilized when transferring vessel 100 to or from some manufacturing element or device (e.g., a molding machine, a blower, etc.). Transfer bead 120 may be retain a transfer ring of a tamper evident cap (not shown). Transfer bead 120 may be a sub-element of neck finish 110.

Neck 130 may have a cylindrical or annular shape and extend out from shoulder extension 140 to the transfer bead 120 or neck finish and mouth 110.

Shoulder extension 140 may have a spherical segment shape as shown. As another example, in some embodiments, shoulder extension 140 may have a conical segment shape (e.g., with straight rather than rounded sides from an elevation view).

Shoulder support 150 may include a flat, smooth surface that may be complementary to at least a portion of base 610.

Heel 160 may have a spherical segment shape as shown. Heel 160 may extend from sidewalls 220 to base 610.

Structural support elements 170-190 may include, for example, "ribs" 170, impressions 180, "coins" 190, and/or other appropriate elements. Ribs 170 may have a generally concave shape with convex returns, as shown.

In this example, a set of ribs 170 is arranged in a nested zig-zag or serrated pattern along the front of vessel 100, as shown. Further, in this example a number of ribs have horizontal linear portions that are parallel to horizontal axis 720 (also perpendicular to vertical axis 710) that may run through the handle 310, grip regions 910, and/or the front of vessel 100. In addition, in this example, some ribs have arcing or curved sections, such as those along portions of the rear of vessel 100. Such curved sections may provide additional structural support for elements such as handle portion 240. Structural support elements 170-190 may provide improved grip for users in addition to structural reinforcement of the vessel 100.

Shoulder portion 210 may include shoulder extension 140, shoulder support 150, and a sloped portion of vessel 100 leading to sidewall or body portion 220.

Sidewall or body portion 220 may extend between shoulder portion 210 and base portion 230. Sidewall portion 220 may have a rounded rectangular cuboid shape as shown. The sidewalls 220 may provide a relatively square profile which provides load bearing edges for vertically arranged like containers 100.

Structural support "coins" 190 are provided at the shoulder corners for loadbearing strength, and multiple stiffening ribs 170 and/or other structural support elements 180 may be provided along the body of the container as shown. In this example, structural support elements 180 have a rhombus-shaped outline and support coins 190 have a rounded triangle shape as shown.

Grip regions 910 may allow a consumer or other user to grasp the container 100 with a single hand to remove a container 100 from the stacked configuration 1200 and/or to otherwise manipulate a container 100. Details may be included around the grip region 910 to provide strength to the region 1410. In this example, vessel 100 includes a set of grip regions 910 including a pair of such grip regions 910. Different embodiments may have different numbers of grip regions.

The dimensions of the female coupling 620 are such that neck finish 110, neck 130, and shoulder extension 140 form a complementary male coupling received therein. Thus, the female coupling 620 on the bottom surface or base 610 of an upper container 100 may receive the neck finish 110, neck 130, and shoulder extension 140 of a below container 100 (if any). Moreover, the weight of the above container 100 may be supported by the sidewalls 220. In particular, the bottom edges or base 610 of the sidewalls 220 of the above container(s) may align with and rest on the shoulder supports 150 at the top edges of the sidewalls 220 of the respective below container 100. In this manner the containers 100 may be vertically stacked and nested to each other to provide support for the vertical weight forces of the stacked configuration 1200 of containers 100.

Base portion 230 may include heel 160, base 610, and recess 620.

Handle portion (or "area" or "region") 240 may include handle 310, grip regions 910, and portions of sidewalls 220.

Handle or "grip" 310 may be disposed along a vertical corner 510 of the rounded square shape container 100. Such a location may provide a more stable and structurally sound bottle 100 and also allows for improved performance, by causing liquid to flow along an opposite vertical corner 510.

Base 610 may be, or include, a flat, smooth surface that is parallel to horizontal axis 720. Base 610 may include receptacle 620.

Stacking receptacle, or "recess", or "seat", or "female coupling" 620 may house or accept a portion of another stackable vessel 100. For instance, receptacle 620 may receive the neck finish 110, neck 130, and shoulder extension 140 of another stackable vessel 100. The receptacle or cavity 620 may allow the weight of stacked vessels 100 to be distributed through the sidewalls 220 rather than the neck finish 110, neck 130, or other more vulnerable portions of vessel 100. Stacking receptacle 620 may be sized to be slightly larger than the complementary male portion of vessel 100 such that there is a gap or clearance between the receptacle 620 and associated male coupling.

Receptacle supports 630 may be similar to structural supports 170 described above. Receptacle supports 630 may extend radially outward from center vertical axis 710, as shown.

Vertical axis or reference line 710 may be aligned with a center of vessel 100 when viewed from above or below. Vessel 100 may be symmetrical about vertical axis 710 when viewed from the front, rear, top, or bottom.

Horizontal axis or reference line 720 may be perpendicular to vertical axis 710. Horizontal axis 720 runs through a portion of handle area 240.

Each grip region (or grip "portion") 910 may include a cavity or recess along the handle portion 240 of vessel 100. Such grip regions 910 may be sized to accept a thumb and multiple fingers of a user.

Figure 12:
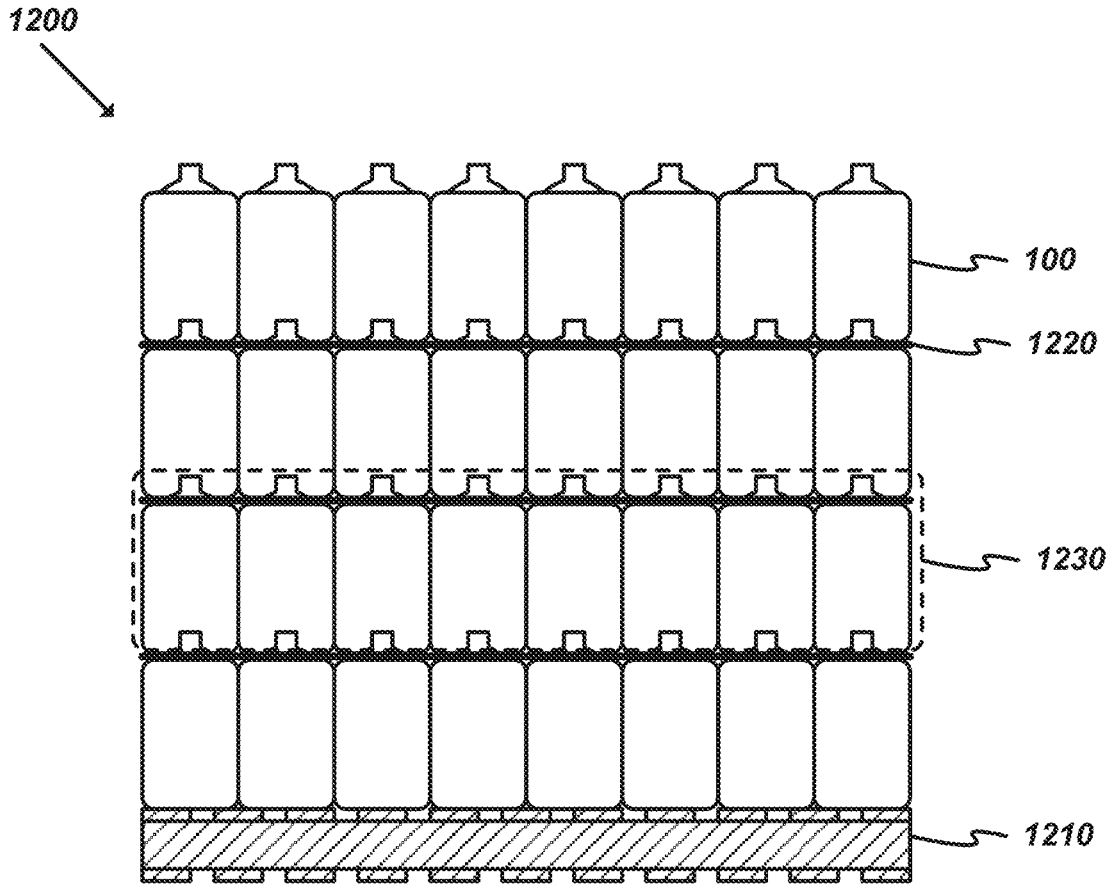
FIG. 12 illustrates a front elevation view of an example storage configuration of one or more embodiments described herein.

FIG. 12 illustrates a front elevation view of an example storage configuration 1200 of one or more embodiments described herein. As shown, storage configuration 1200 may include multiple stackable liquid vessels 100, a pallet or other support 1210, and one or more structural support elements 1220.

Pallet or other support 1210 may be made from rigid or semi-rigid materials such as wood, metal, plastic, etc. Pallets 1210 may have rectangular shapes of various standard dimensions (e.g., forty-eight inches by forty inches, thirty-six inches by thirty-six inches, forty-eight inches by forty-eight inches, etc.).

Stackable liquid vessels 100 may be arranged in tiers 1230. Each tier 1230 may include multiple vessels 100 arranged in multiple columns and multiple rows, where each vessel 100 may be arranged or oriented such that the vertical sides are aligned with vertical sides of adjacent vessels 100 to maximize contact of sidewalls 220 between, and among, adjacent vessels 100.

Figure 13:
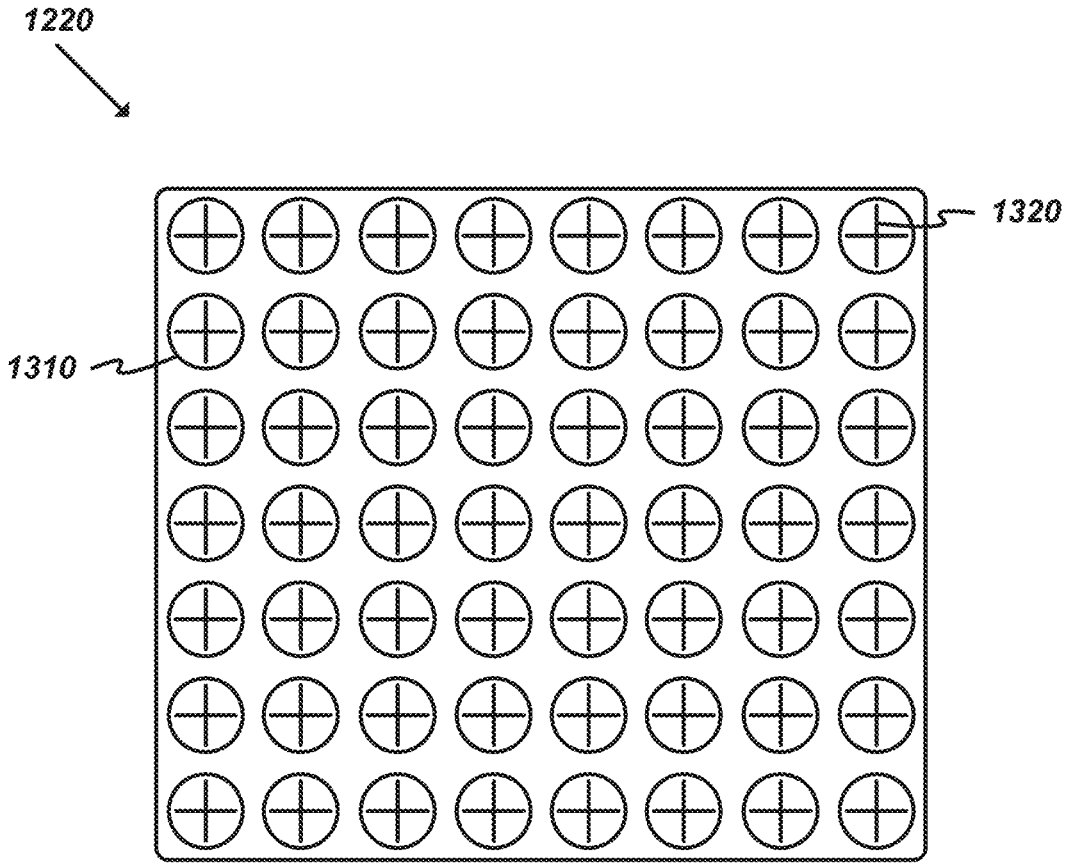
FIG. 13 illustrates a top plan view of a structural support element included in the example storage configuration of FIG. 12.

FIG. 13 illustrates a top plan view of a structural support element 1220 included in the example storage configuration 1200. In this example, the structural support element 1220 may be a perforated slip sheet that includes multiple perforated areas 1310 and associated perforations 1320.

Each structural support element 1220 may include materials such as plastic, corrugated packaging or corrugate, cardboard, wood, and/or other appropriate materials. Structural support element 1220 may have a rectangular shape as shown, and may have an appropriate thickness to provide structural rigidity for the tier of vessels 100. Each perforated area 1310 may be, or include, a complementary section to at least a portion of the male coupling of vessel 100, such that a portion of vessel 100 is able to pass through and/or otherwise engage or couple to structural support element 1220. In this example, each perforated area 1310 has a circular shape that is complementary to a portion of the shoulder area 210. Perforations 1320 may allow the structural support element 1220 to be coupled to, and/or decoupled from, a tier 1230 of vessels 100. Structural support element 1220 may keep the vessels 100 aligned along each tier 1230 and ensure that weight is dispersed via the sidewalls 220 rather than the neck finish 110, neck 130, and/or other more vulnerable portions of vessel 100.

Figure 14:
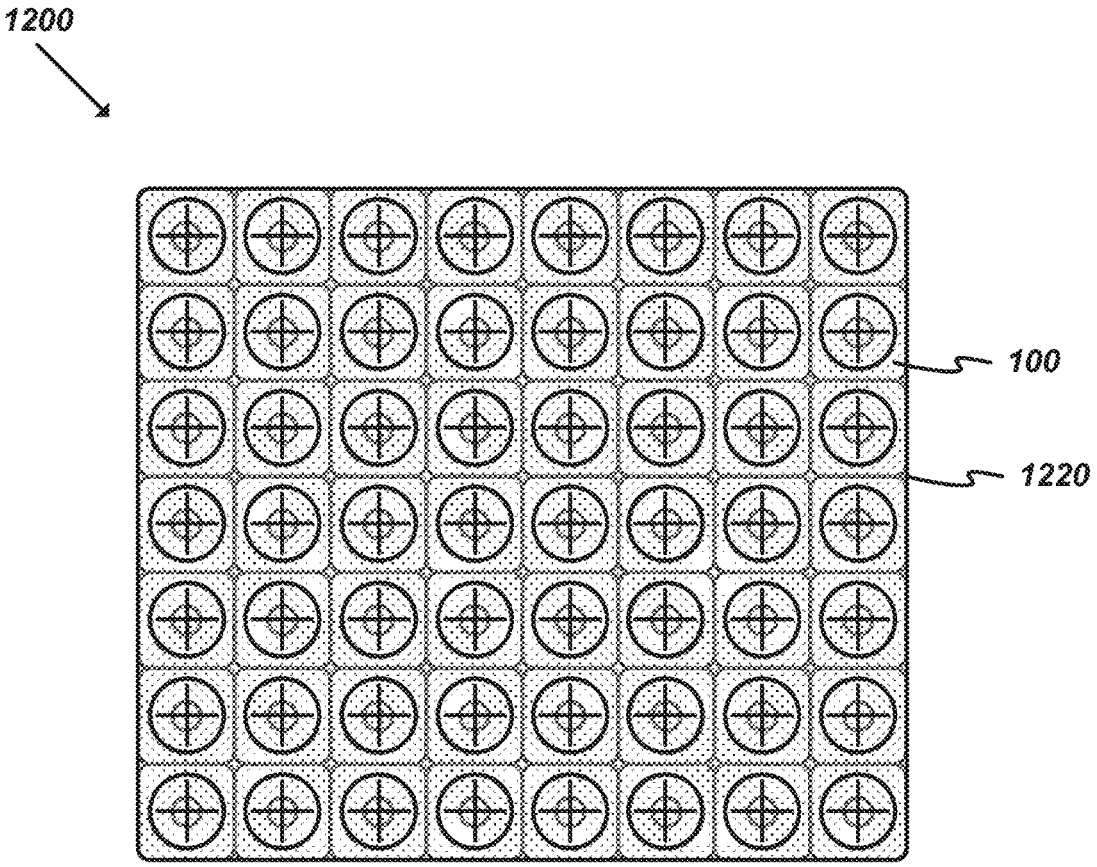
FIG. 14 illustrates a top plan view of the example storage configuration of FIG. 12.

FIG. 14 illustrates a top plan view of the example storage configuration 1200. As shown, the rounded rectangular cuboid shape of the vessels 100 maximizes bottle-to-bottle contact along the vertical side portions of sidewalls 220 (and/or other portions of vessel 100) such that weight is evenly, and contiguously, distributed across a pallet 1210 or other support and eliminating secondary packaging required by more rounded shapes.

Containers, such as stackable liquid vessel 100 may typically be positioned on a pallet 110 for movement (e.g., by a hand truck, forklift, etc.) about a retail establishment and may often be located in an open area between or at the end of shopping aisles. Displays may include several tiers 1230 of nested beverage containers 100 such as large plastic bottles. For previous stackable containers, the weight of an upper container of a stack may weaken the neck portion of a lower container of the stack, causing damaged, deformed, broken, or otherwise compromised containers. Such damage makes for an unappealing consumer merchandising experience and, in certain instances, can cause leakage of content from the containers. A reason for such drawbacks is that the neck of the bottle below functions as a stabilizing factor in the merchandising display. As the rows of containers increase, the weight applied to the lower containers increase, thus causing damage in transit and/or during merchandising in the store.

In addition to the above drawbacks, each pallet requires a fair amount of secondary packaging to provide integrity to the package during transit. The need for secondary packaging does not answer the demand of the retailer to remove almost all or all of the secondary packaging, which clutters the store and creates an unsightly and potentially unsafe condition for consumers as well as store staff. The secondary packaging may include boxes, extra corrugate stabilizers, plastic stabilizers and hard edges, which were required to hold the containers together on the pallets from a stability standpoint in logistics/shipment as well as on the floor of the retailer. When a consumer attempts to open such packaging to remove containers from the stack, the extra packaging may be moved around by the consumer, discarded on the floor, and over the period of the day where the pallet is shopped, the mess of corrugate and plastic in the rack or aisle becomes clutter. Store staff are then needed to merchandise (clean up, remove layers, open new layers, remove shipping materials, etc.) the product to continually be shopped by the consumer.

According to an example embodiment, a large beverage container 100, such as a one-gallon size container, may be provided in a stackable bottle configuration with minimal secondary packaging required when such bottles 100 are palletized. The stackable bottles 100 may be arranged in a nested and stacked storage configuration 1200 on a base such as a pallet 1210 for merchandising in a retail establishment. Thus container 100 addresses a need of retailers wanting the removal of secondary packaging from the pallet 1210.

According to the present invention, substantially all secondary packaging is not required in the finished pallet 1210. In some embodiments, perforated slip sheets 1220 are disposed between layers of the stack of containers 100 on the pallet 1210. The slip sheets 1220, in conjunction with the bottle design, provide stability to a bottle stack. The pallet 1210 may be dropped in place by the retailer, plastic stretch film cut off the pallet 1210 and removed to provide access to the containers/bottles 100, the top slip sheet 1220 removed, and the consumer can then shop the pallet 1210, without having to navigate any secondary packaging. When a tier 1230 of the stacked configuration 1200 is empty, the next slip sheet 1220 may be removed to allow access to the next tier 1230 and so on. Once the pallet 1210 is shopped down to the remaining bottle 100, all that remains are the slip sheets 1220 and the pallet 1210. There is no requirement of store staff to merchandise the pallet 1210, as there is no mess to maintain, packages to open or materials to remove and the consumer has absolute access to the product without any hindrance.

From a retailer perspective, particularly on the logistics, transportation and warehousing side, the challenge of, for example, June to November in many climates of the United States where humidity is extremely high and temperatures are high, the corrugate and secondary packaging of the previous designs become very weak due to the humidity. This causes pallet failure and/or requires rewrapping of pallets 1210 in warehouses. For customers with large distribution centers with sometimes hundreds of pallets 1210 moving per day, the havoc created by such failure and required rewrapping is both massively frustrating, expensive and potentially dangerous. As a one gallon bottle of water weighs approximately eight-and-one-half pounds, having close to two hundred fifty on a pallet 1210 that is fairly or extremely weakened due to the corrugate being impacted by the liquid (e.g., humidity, precipitation, etc.) is an enormous challenge. With the stackable liquid vessel 100, and the elimination of all secondary packaging, other than rigid, thick corrugate slip sheets 1220, there is no chance of pallets 1210 "bowing" or weakening as there is no secondary packaging in the product to become weak or fail. Secondarily, the removal of the need to merchandise the pallet 1210 in the retail store is a major time and expense saver. Thirdly, the risk or potential of risk with the secondary packaging being ripped open, plastic and cardboard strewn about the aisle and under the racks was and is a potentially liability for the retailer. Having the containers 100 freely accessible, and also stable, removes a significant potential for risk by eliminating excess materials and preventing containers 100 falling out of weakened boxes or support materials, such as with previous designs or product offerings.

In some embodiments, container 100 may be a bottle for a relatively large volume of water as is typically used by consumers with a bottle cooler and/or dispenser. Stackable liquid vessel 100 may have a volume or capacity of three thousand eight hundred milliliter (or three and eight-tenths liter) bottle in some embodiments. One of ordinary skill in the art will recognize that stackable liquid vessel 100 may be provided in various appropriate sizes that may be larger or smaller than the example container 100 (e.g., two liter, one gallon, two gallons, etc.).

Storage configuration 1200 may include multiple stacks of containers 100 arranged on a pallet 1210. The containers 100 may be organized in multiple tiers 1230 (four such tiers are shown by way of example). In some embodiments, a standard wood pallet may support five tiers 1230 of container 100 with each tier 1230 including eight rows and seven columns for a total container count of two hundred eighty containers 100 per pallet 1210. A slip sheet 1220 may be positioned at the tops of each tier of containers 100. The slip sheets 1220 may include holes 1310 to receive the neck finish 110 of each container 100 in the particular tier 1230. Each slip sheet 1220 may be made of rigid material or materials such as corrugate paper of a sufficient thickness to provide support to the neck finishes and mouths 110 of each container 100 in a tier 1230.

In use, a stacked storage configuration 1200 may typically be shipped with a plastic wrapping around the periphery of the stacked configuration 1200 (not shown) and the pallet 1210 may be moved to a desired position within a shopping environment and/or other environments (e.g., a warehouse, a shipping container or, a vehicle, etc.). Once in place at a retailer, the plastic wrapping and the top slip sheet 1220 may be removed and discarded, thereby providing consumers with access to the containers 100. Once a tier 1230 of containers 100 is emptied, the next slip sheet 1220 may be removed and discarded, whereupon the next tier 1230 of containers 100 may be shopped, and so on. When the stacked configuration 1200 is depleted of containers 100, all that remains is a single pallet 1210 which may then be easily removed and replaced by another stacked configuration 1200.

As one specific example embodiment, a three and eight-tenths liter bottle 100 may have a total height 730 of two hundred ninety seven millimeters, within appropriate tolerances (e.g., plus or minus one-half percent, one percent, two percent, five percent, etc.). Continuing the specific example, the three and eight-tenths liter bottle 100 may have a width 920 of one hundred forty-one and six tenths millimeters, within appropriate tolerances. Further continuing this specific example, the height to transfer bead 120 may be two hundred seventy-eight and four tenths millimeters, within appropriate tolerances. Further continuing this specific example, the inner handle width 930 may be sixty-eight and three tenths millimeters, within appropriate tolerances. Further continuing this specific example, the outer handle width 940 may be eighty-four and three tenths millimeters, within appropriate tolerances. Further continuing this specific example, vessel 100 may have an inner mouth diameter of thirty-four and five tenths millimeters, within appropriate tolerances. Further continuing this specific example, vessel 100 may have a transfer bead outer diameter of forty-one and eight tenths millimeters, within appropriate tolerances. Further continuing this specific example, vessel 100 may have a receptacle 620 with a height of forty-nine and one tenth millimeters along axis 710 and an outer radius of one hundred seven and one tenth millimeters along an axis parallel to line 720, within appropriate tolerances. Further continuing this specific example, the material weight of such a three and eight-tenths liter bottle 100 may be between sixty-two and sixty-six grams, within appropriate tolerances.

One of ordinary skill in the art will recognize that different embodiments may have different capacities, dimensions, and/or other different attributes (e.g., rib placement or shape) than those discussed in reference to the examples described herein.

No element, act, or instruction used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items and may be used interchangeably with the phrase "one or more." Where only one item is intended, the terms "one," "single," "only," or similar language is used. Further, the phrase "based on" is intended to mean "based, at least in part, on" unless explicitly stated otherwise.

The foregoing relates to illustrative details of exemplary embodiments and modifications may be made without departing from the scope of the disclosure. Even though particular combinations of features are recited in the claims and/or disclosed in the specification, these combinations are not intended to limit the possible implementations of the disclosure. In fact, many of these features may be combined in ways not specifically recited in the claims and/or disclosed in the specification. For instance, although each dependent claim listed below may directly depend on only one other claim, the disclosure of the possible implementations includes each dependent claim in combination with every other claim in the claim set.

We claim:

1. A stacked configuration of stackable liquid vessels, the stacked configuration comprising:

a plurality of tiers of stackable liquid vessels, each tier from the plurality of tiers of stackable liquid vessels comprising:

a plurality of stackable liquid vessels arranged in a plurality of columns and a plurality of rows; and a perforated slip sheet that selectively couples to and decouples from the plurality of stackable liquid vessels, the perforated slip sheet arranged parallel to each tier, wherein the plurality of tiers of stackable liquid vessels requires no support members that are perpendicular to the perforated slip sheets, and wherein each stackable liquid vessel comprises:

a body portion having a rounded cuboid shape, the body portion centered about a center axis of the stackable liquid vessel;

a shoulder portion coupled to the body portion, the shoulder portion comprising:

a sloped portion coupled to the body portion, wherein the sloped portion has a rounded pyramid frustum shape and wherein each corner of the sloped portion is associated with a structural support impression;

a shoulder support coupled to the sloped portion, the shoulder support comprising a planar surface that is perpendicular to the center axis of the stackable liquid vessel; and a shoulder extension coupled to the shoulder support, the shoulder extension having a spherical segment shape; and a cylindrical neck coupled to the shoulder extension, the cylindrical neck centered about the center axis of the stackable liquid vessel.

2. The stacked configuration of claim 1, wherein the stacked configuration of stackable liquid vessels comprises five or more tiers.

3. The stacked configuration of claim 1, wherein the stacked configuration of stackable liquid vessels includes seven columns and the plurality of rows includes eight rows.

4. A stackable liquid vessel comprising:

a body portion having a rounded cuboid shape, the body portion centered about a center axis of the stackable liquid vessel;

a shoulder portion coupled to the body portion, the shoulder portion comprising:

a sloped portion coupled to the body portion, wherein the sloped portion has a rounded pyramid frustum shape and wherein each corner of the sloped portion is associated with a structural support impression;

a shoulder support coupled to the sloped portion, the shoulder support comprising a planar surface that is perpendicular to the center axis of the stackable liquid vessel; and a shoulder extension coupled to the shoulder support, the shoulder extension having a spherical segment shape; and a cylindrical neck coupled to the shoulder extension, the cylindrical neck centered about the center axis of the stackable liquid vessel.

5. The stackable liquid vessel of claim 4, wherein the structural support impression has a rounded triangle shape.

6. The stackable liquid vessel of claim 4, wherein the body portion comprises a complementary receptacle that accepts at least the cylindrical neck and shoulder extension of an associated stackable liquid vessel.

7. The stackable liquid vessel of claim 4 further comprising an integrated handle that includes a set of grip region cavities along the body portion.

8. The stackable liquid vessel of claim 7, wherein the integrated handle is disposed along a vertical corner of the stackable liquid vessel.

9. The stackable liquid vessel of claim 4 further comprising a set of ribs.

10. The stackable liquid vessel of claim 9, wherein a plurality of ribs from the set of ribs run along a path perpendicular to the vertical axis.

11. A stackable liquid vessel comprising:

a body portion having a rounded cuboid shape with four vertical sidewalls, the body portion centered about a center axis of the stackable liquid vessel;

a shoulder portion coupled to the body portion, the shoulder portion comprising:

a sloped portion coupled to the body portion, wherein the sloped portion has a rounded pyramid frustum shape and wherein each face of the sloped portion is aligned with one of the four vertical sidewalls, wherein each corner of the sloped portion is associated with a structural support impression having a rounded triangle shape;

a shoulder support coupled to the sloped portion, the shoulder support comprising a planar surface that is perpendicular to the center axis of the stackable liquid vessel; and a shoulder extension coupled to the shoulder support, the shoulder extension having a spherical segment shape; and a cylindrical neck coupled to the shoulder extension, the cylindrical neck centered about the center axis of the stackable liquid vessel.

12. The stackable liquid vessel of claim 11, wherein the body portion comprises a complementary receptacle that accepts at least the cylindrical neck and shoulder extension of an associated stackable liquid vessel.

13. The stackable liquid vessel of claim 11 further comprising an integrated handle that includes a set of grip region cavities along the body portion.

14. The stackable liquid vessel of claim 13, wherein the integrated handle is disposed along a vertical corner of the stackable liquid vessel.

15. The stackable liquid vessel of claim 11 further comprising a set of ribs.

16. The stackable liquid vessel of claim 15, wherein a plurality of ribs from the set of ribs run along a path perpendicular to the vertical axis.

* * * * *